US010610080B2

(12) United States Patent
Dogan et al.

(10) Patent No.: US 10,610,080 B2
(45) Date of Patent: Apr. 7, 2020

(54) DISH WASHING MACHINE

(71) Applicant: FOSHAN SHUNDE MIDEA WASHING APPLIANCES MFG. CO., LTD., Foshan (CN)

(72) Inventors: Yilmaz Dogan, Foshan (CN); Feng Gao, Foshan (CN)

( * ) Notice: Subject to any disclaimer, the term of this patent is extended or adjusted under 35 U.S.C. 154(b) by 200 days.

(21) Appl. No.: 15/575,384

(22) PCT Filed: May 19, 2015

(86) PCT No.: PCT/CN2015/079318
§ 371 (c)(1),
(2) Date: Nov. 20, 2017

(87) PCT Pub. No.: WO2016/183808
PCT Pub. Date: Nov. 24, 2016

(65) Prior Publication Data

US 2018/0153369 A1 Jun. 7, 2018

(51) Int. Cl.
*A47L 15/48* (2006.01)
*A47L 15/42* (2006.01)
*A47L 15/46* (2006.01)

(52) U.S. Cl.
CPC ..... *A47L 15/4242* (2013.01); *A47L 15/4246* (2013.01); *A47L 15/4276* (2013.01); *A47L 15/4251* (2013.01); *A47L 15/46* (2013.01); *A47L 2301/04* (2013.01); *A47L 2401/20* (2013.01);
(Continued)

(58) Field of Classification Search
None
See application file for complete search history.

(56) References Cited

U.S. PATENT DOCUMENTS

2007/0131259 A1* 6/2007 Classen ..... A47L 15/4276 134/56 D
2015/0342441 A1* 12/2015 Hahm ..... A47L 15/481 34/79

FOREIGN PATENT DOCUMENTS

CN 101803896 A 8/2010
CN 102449226 A 5/2012
CN 104856627 A 8/2015
(Continued)

OTHER PUBLICATIONS

European Office Action dated May 4, 2018 in the corresponding European application (application No. 15892187.4).
(Continued)

*Primary Examiner* — Michael E Barr
*Assistant Examiner* — Jason P Riggleman
(74) *Attorney, Agent, or Firm* — Kilpatrick Townsend & Stockton, LLP

(57) ABSTRACT

Disclosed is a dishwasher (10). The dishwasher (10) comprises a body (101), an air passage (102), catalyst pieces (103) having nanometer titanium dioxide, and an ultraviolet lamp (104) used for emitting ultraviolet light to the catalyst pieces (103). An accommodating cavity (1011) used for accommodating tableware is defined in the body (101). A gas inlet (1012) and a gas outlet (1013) are defined in the wall of the accommodating cavity (1011). An air outlet of the air passage (102) is in communication with the gas inlet (1012), and an air inlet of the air passage (102) is in communication with the gas outlet (1013). The catalyst pieces (103) are disposed in the air passage (102). The ultraviolet lamp (104) is disposed in the air passage (102).

8 Claims, 2 Drawing Sheets

(52) U.S. Cl.
CPC ..... *A47L 2401/22* (2013.01); *A47L 2501/16* (2013.01); *A47L 2501/34* (2013.01)

(56) References Cited

FOREIGN PATENT DOCUMENTS

| | | | | |
|---|---|---|---|---|
| CN | 204618137 | U | | 9/2015 |
| DE | 3626887 | A1 | * | 2/1988 |
| DE | 3626887 | A1 | | 2/1988 |
| EP | 1872704 | A1 | | 1/2008 |
| JP | 2005118209 | A | | 5/2005 |
| JP | 2005143881 | A | * | 6/2005 |

OTHER PUBLICATIONS

Chinese Office Action dated Jan. 26, 2017 in the corresponding Chinese application(application No. 201510260291.2).

* cited by examiner

DISH WASHING MACHINE

CROSS-REFERENCE TO RELATED APPLICATION

The present application is a national phase entry under 35 USC § 371 of International Application PCT/CN2015/079318, filed May 19, 2015, the entire disclosure of which is incorporated herein by reference.

FIELD

The present invention relates to a field of household appliances, and more particularly to a dishwasher.

BACKGROUND

A dishwasher is used to clean tableware. The dishwasher may reek a smelly odor due to the dirty tableware to be washed, deposition of food particles in a drainage passage of the dishwasher, and other reasons.

SUMMARY

Embodiments of the present invention seek to solve at least one of the problems existing in the related art to at least some extent. Accordingly, the present invention provides a dishwasher having clean, hygienic and odorless advantages.

The dishwasher according to embodiments of the present invention includes: a body defining an accommodating cavity used to accommodate tableware, a gas inlet and a gas outlet being defined in a wall of the accommodating cavity; an air passage having an air outlet in communication with the gas inlet, and an air inlet in communication with the gas outlet; a catalyst piece having nanometer titanium dioxide and provided in the air passage; and an ultraviolet lamp configured to emit ultraviolet light to the catalyst piece and provided in the air passage.

The dishwasher according to embodiments of the present invention has clean, hygienic and odorless advantages.

In addition, the dishwasher according to the above embodiments of the present invention can have the following technical features.

According to an embodiment of the present invention, the gas inlet is defined in a peripheral wall of the accommodating cavity and adjacent to a bottom wall of the accommodating cavity, and the gas outlet is defined in the peripheral wall of the accommodating cavity and adjacent to a top wall of the accommodating cavity.

According to an embodiment of the present invention, the catalyst piece includes a substrate and a nanometer titanium dioxide coating applied on the substrate.

According to an embodiment of the present invention, a plurality of catalyst pieces are provided and spaced apart along a length direction of the ultraviolet lamp, and a length direction of each catalyst piece is perpendicular to the length direction of the ultraviolet lamp.

According to an embodiment of the present invention, the dishwasher further includes a fan provided in the air passage.

According to an embodiment of the present invention, a plurality of fans are provided.

According to an embodiment of the present invention, the dishwasher further includes a fan; the air passage includes a first sub air passage and a second sub air passage; the first sub air passage has an air inlet in communication with the gas outlet and an air outlet in communication with an air inlet of the fan, and the second sub air passage has an air inlet in communication with an air outlet of the fan and an air outlet in communication with the gas inlet.

According to an embodiment of the present invention, the catalyst piece and the ultraviolet lamp are provided in the second sub air passage.

According to an embodiment of the present invention, the second sub air passage includes: a first connecting segment having a first end connected with the air outlet of the fan; a second connecting segment having a first end connected with the gas inlet; an expanding segment having a first end connected with a second end of the first connecting segment; a receiving segment having a first end connected with a second end of the expanding segment, the catalyst piece and the ultraviolet lamp being arranged in the receiving segment; and a narrowing segment having a first end connected with a second end of the receiving segment and a second end connected with a second end of the second connecting segment, in which a diameter of the receiving segment is equal to a maximum diameter of the expanding segment and a maximum diameter of the narrowing segment.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Embodiments of the present invention will be described in detail in the following, and examples of the embodiments will be shown in drawings. The embodiments described herein with reference to drawings are explanatory, and used to interpret the present invention. The embodiments shall not be construed to limit the present invention.

Figure 1:
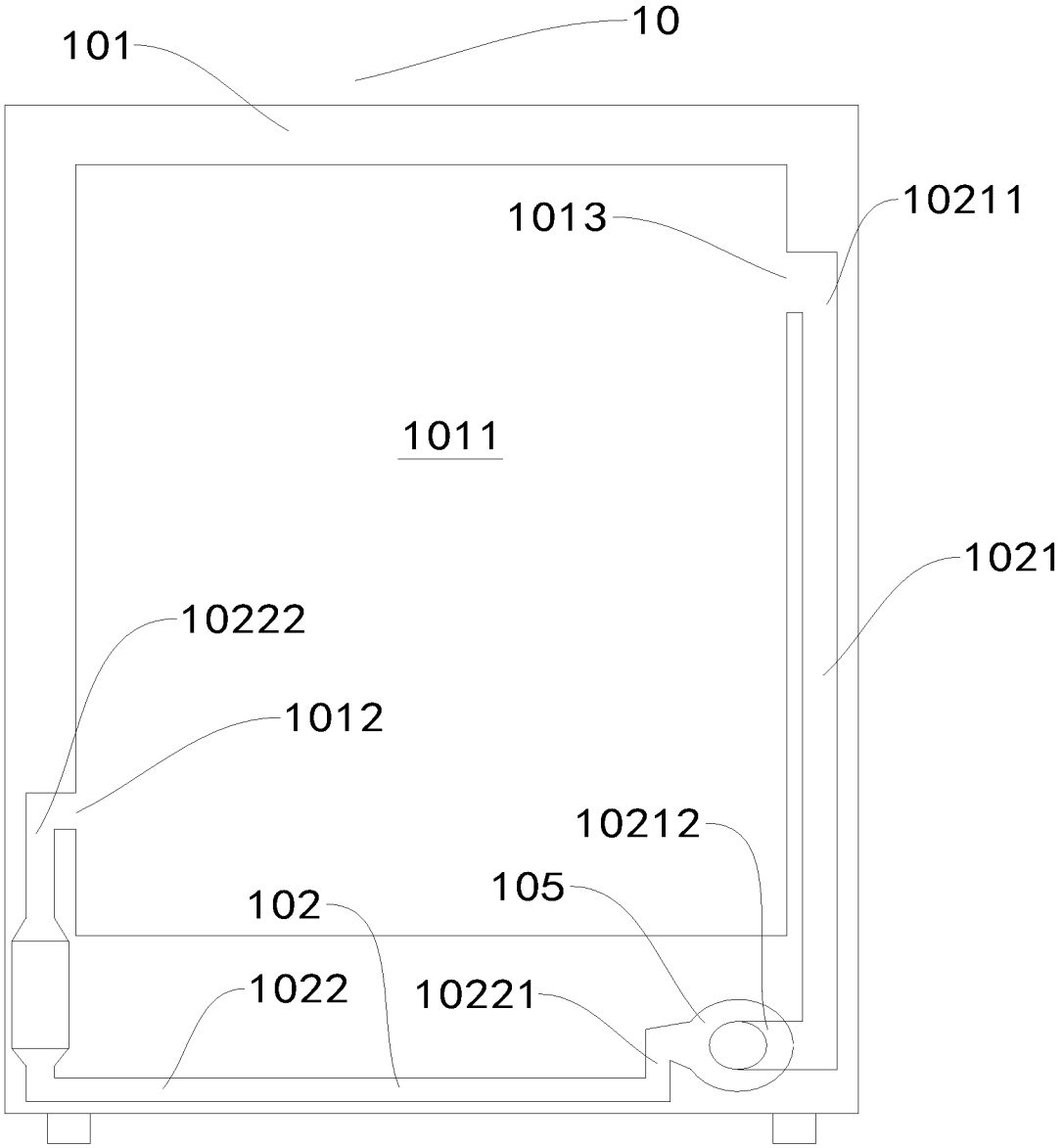
FIG. 1 is a schematic view of a dishwasher according to an embodiment of the present invention.
Figure 2:
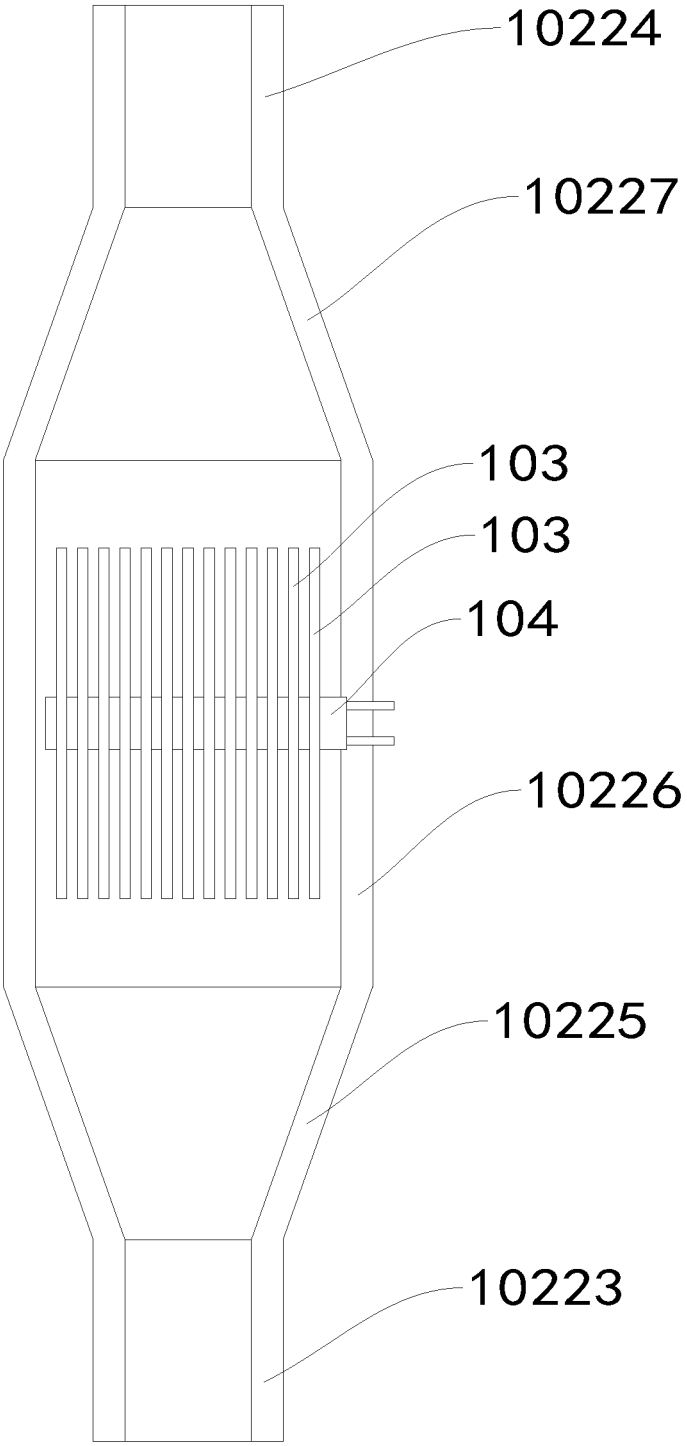
FIG. 2 is a partially schematic view of a dishwasher according to an embodiment of the present invention.

A dishwasher 10 according to embodiments of the present invention will be described with reference to the drawings. As shown in FIGS. 1 and 2, the dishwasher 10 includes a body 101, an air passage 102, a catalyst piece 103 having nanometer titanium dioxide, and an ultraviolet lamp 104 used to emit ultraviolet light to the catalyst piece 103.

An accommodating cavity 1011 used to accommodate tableware is defined in the body 101. A gas inlet 1012 and a gas outlet 1013 are defined in a wall of the accommodating cavity 1011. An air outlet of the air passage 102 is in communication with the gas inlet 1012, and an air inlet of the air passage 102 is in communication with the gas outlet 1013. The catalyst piece 103 is provided in the air passage 102, and the ultraviolet lamp 104 is provided in the air passage 102.

When the dishwasher 10 reeks a smelly odor or after the dishwasher 10 has been used for a period of time, a user may turn on the ultraviolet lamp 104, and the ultraviolet lamp 104 emits the ultraviolet light to the catalyst piece 103 for photocatalysis, thereby producing hydroxyl radicals (OH radicals) and peroxide ions with high electroactivity. The hydroxyl radicals and peroxide ions can enter the accommodating cavity 1011 through the air passage 102. The hydroxyl radicals and peroxide ions can be combined with contaminants (such as bacteria, fungi, volatile organic compounds, any other substances that can produce unpleasant odors) in the air within the accommodating cavity 1011, and a chemical reaction may occur after the combination, so as to oxidize these contaminants effectively. Thus, these contaminants are decomposed (destroyed) into harmless carbon dioxide and water molecules, thereby eliminating the unpleasant odors from the dishwasher 10, and making the air in the accommodating cavity 1011 cleaner and odorless.

For the dishwasher 10 according to embodiments of the present invention, the ultraviolet lamp 104 and the catalyst piece 103 having nanometer titanium dioxide are arranged in the air passage 102, thus the ultraviolet light can radiate the catalyst piece 103 to produce the hydroxyl radicals and peroxide ions, such that the hydroxyl radicals and peroxide ions can be utilized to oxidize the contaminants (such as bacteria, fungi, volatile organic compounds, and so on) and produce harmless carbon dioxide and water molecules. Thus, the air within the accommodating cavity 1011 in the dishwasher 10 can become cleaner and odorless, thereby making the dishwasher 10 cleaner and more hygienic.

In addition, the photocatalysis has advantages of low cost, easy accomplishment, non-toxic, chemical mechanical stability and high utilization rate. Moreover, the photocatalysis may avoid production of an intermediate product compared with direct photolysis technology.

Therefore, the dishwasher 10 according to embodiments of the present invention has clean, hygienic and odorless advantages.

As shown in FIGS. 1 and 2, the dishwasher 10 according to some embodiments of the present invention includes the body 101, the air passage 102, the catalyst piece 103 having nanometer titanium dioxide, and the ultraviolet lamp 104 used to emit ultraviolet light to the catalyst piece 103.

The accommodating cavity 1011 used to accommodate tableware is defined in the body 101. The gas inlet 1012 and the gas outlet 1013 are defined in the wall of the accommodating cavity 1011. Advantageously, as shown in FIG. 1, the gas inlet 1012 is provided in a peripheral wall of the accommodating cavity 1011 and adjacent to a bottom wall of the accommodating cavity 1011; the gas outlet 1013 is provided in the peripheral wall of the accommodating cavity 1011 and adjacent to a top wall of the accommodating cavity 1011.

The hydroxyl radicals and peroxide ions enter the accommodating cavity 1011 through the gas inlet 1012 adjacent to the bottom wall of the accommodating cavity 1011, and flow upwards, so as to oxidize the contaminants throughout the whole accommodating cavity 1011 and avoid any dead area. Thus, the dishwasher 10 can have a more reasonable structure.

In an embodiment of the present invention, the dishwasher 10 further includes a fan 105, and the fan 105 is provided in the air passage 102. By providing the fan 105, it is possible to step up a flow rate of the hydrogen radicals and the peroxide ions in the accommodating cavity 1011, thereby accelerating a speed of eliminating the unpleasant odor from the dishwasher 10.

Advantageously, a plurality of fans 105 may be provided, so as to further step up the flow rate of the hydrogen radicals and the peroxide ions in the accommodating cavity 1011 and hence accelerate the speed of eliminating the unpleasant odor from the dishwasher 10.

As shown in FIG. 1, in some examples of the present invention, the dishwasher 10 further includes the fan 105, and the air passage 102 includes a first sub air passage 1021 and a second sub air passage 1022. An air inlet 10211 of the first sub air passage 1021 is in communication with the gas outlet 1013, and an air outlet 10212 of the first sub air passage 1021 is in communication with an air inlet of the fan 105; an air inlet 10221 of the second sub air passage 1022 is in communication with an air outlet of the fan 105, and an air outlet 10222 of the second sub air passage 1022 is in communication with the gas inlet 1012. Thus, the fan 105 can be installed more conveniently and easily, and the structure of the dishwasher 10 can become more reasonable.

The catalyst piece 103 can include a substrate and a nanometer titanium dioxide coating on the substrate. That is, nanometer titanium dioxide can be a film supported on a suitable substrate, and can be easily separated from treated water.

As shown in FIG. 2, in an example of the present invention, a plurality of catalyst pieces 103 can be provided and spaced apart along a length direction of the ultraviolet lamp 104. A length direction of each catalyst piece 103 is perpendicular to the length direction of the ultraviolet lamp 104. Thus, a photocatalytic reaction can be performed better, and more hydroxyl radicals and peroxide ions can be produced, so as to purify the air in the accommodating cavity 1011 and eliminate the unpleasant odor in the accommodating cavity 1011 more effectively.

Advantageously, the catalyst piece 103 and the ultraviolet lamp 104 are provided in the second sub air passage 1022. Thus, the structure of the dishwasher 10 can become more reasonable.

In a specific example of the present invention, as shown in FIG. 2, the second sub air passage 1022 includes a first connecting segment 10223, a second connecting segment 10224, an expanding segment 10225, a receiving segment 10226 and a narrowing segment 10227. A first end of the first connecting segment 10223 is connected with the air outlet of the fan 105, and a first end of the second connecting segment 10224 is connected with the gas inlet 1012.

A first end of the expanding segment 10225 is connected with a second end of the first connecting segment 10223. A first end of the receiving segment 10226 is connected with a second end of the expanding segment 10225. The catalyst piece 103 and the ultraviolet lamp 104 are provided in the receiving segment 10226. A first end of the narrowing segment 10227 is connected with a second end of the receiving segment 10226, and a second end of the narrowing segment 10227 is connected with a second end of the second connecting segment 10224.

A diameter of the receiving segment 10226 is equal to a maximum diameter of the expanding segment 10225 and a maximum diameter of the narrowing segment 10227. That is, a space defined in the expanding segment 10225 and a spaced defined in the narrowing segment 10227 each can be shaped into a truncated cone, and a diameter of the space defined in the expanding segment 10225 increases along an air flow direction while a diameter of the space defined in the narrowing segment 10227 decreases along the air flow direction. A spaced defined in the receiving segment 10226 has a cylindrical shape. Thus, the catalyst piece 103 and the ultraviolet lamp 104 can be installed more conveniently and easily, thereby making the structure of the dishwasher 10 more reasonable.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial," and "peripheral" should be construed to refer to the orientation as then described or as shown in the drawings under discussion. These relative terms are for convenience of description and do not require that the present invention be constructed or operated in a particular orientation. Terms used herein should not be construed to limit the present invention.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from the scope of the present invention.

What is claimed is:

1. A dishwasher, comprising:

a body defining an accommodating cavity used to accommodate tableware, a wall of the accommodating cavity defining a gas inlet and a gas outlet;

an air passage having an air outlet in communication with the gas inlet, and an air inlet in communication with the gas outlet;

a catalyst piece having nanometer titanium dioxide and provided in the air passage; and an ultraviolet lamp configured to emit ultraviolet light to the catalyst piece and provided in the air passage;

wherein a plurality of catalyst pieces are provided and spaced apart along a length direction of the ultraviolet lamp, and a length direction of each catalyst piece is perpendicular to the length direction of the ultraviolet lamp.

2. The dishwasher according to claim 1, wherein the gas inlet is defined in a peripheral wall of the accommodating cavity and adjacent to a bottom wall of the accommodating cavity, and the gas outlet is defined in the peripheral wall of the accommodating cavity and adjacent to a top wall of the accommodating cavity.

3. The dishwasher according to claim 1, wherein the catalyst piece comprises a substrate and a nanometer titanium dioxide coating applied on the substrate.

4. The dishwasher according to claim 1, further comprising a fan provided in the air passage.

5. The dishwasher according to claim 4, wherein a plurality of fans are provided.

6. The dishwasher according to claim 1, further comprising a fan, wherein the air passage comprises a first sub air passage and a second sub air passage, the first sub air passage has an air inlet in communication with the gas outlet and an air outlet in communication with an air inlet of the fan, and the second sub air passage has an air inlet in communication with an air outlet of the fan and an air outlet in communication with the gas inlet.

7. The dishwasher according to claim 6, wherein the catalyst piece and the ultraviolet lamp are provided in the second sub air passage.

8. The dishwasher according to claim 7, wherein the second sub air passage comprises:

a first connecting segment having a first end connected with the air outlet of the fan;

a second connecting segment having a first end connected with the gas inlet;

an expanding segment having a first end connected with a second end of the first connecting segment;

a receiving segment having a first end connected with a second end of the expanding segment, the catalyst piece and the ultraviolet lamp being arranged in the receiving segment; and a narrowing segment having a first end connected with a second end of the receiving segment and a second end connected with a second end of the second connecting segment, wherein a diameter of the receiving segment is equal to a maximum diameter of the expanding segment and a maximum diameter of the narrowing segment.

* * * * *